US006446470B1

(12) United States Patent
Wu

(10) Patent No.: US 6,446,470 B1
(45) Date of Patent: Sep. 10, 2002

(54) CLOTH MADE BY CIRCULAR KNITTING MACHINE

(75) Inventor: Chih-Neng Wu, Chang-Hua Hsien (TW)

(73) Assignee: Hour Well Enterprise Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 10/042,089

(22) Filed: Jan. 10, 2002

(51) Int. Cl.[7] ..... D04B 9/42
(52) U.S. Cl. ..... 66/177
(58) Field of Search ..... 66/8, 21, 22, 172 R, 66/173, 175, 176, 177, 178 R, 183

(56) References Cited

U.S. PATENT DOCUMENTS 2,578,895 A * 12/1951 Meengs et al. ..... 66/178 R
2,926,512 A * 3/1960 Robertson ..... 66/173
3,678,514 A * 7/1972 Safrit ..... 2/212
4,513,589 A * 4/1985 Kearns ..... 66/172 E
5,052,058 A * 10/1991 Mueller ..... 2/227
5,428,975 A * 7/1995 Lee et al. ..... 2/239
6,065,311 A * 5/2000 Essig et al. ..... 66/173

* cited by examiner

*Primary Examiner*—Danny Worrell
(74) *Attorney, Agent, or Firm*—Harrison & Egbert

(57) ABSTRACT

A seamless cylindrical cloth material is made by the circular knitting machine and is provided in one or two sides with at least one folded portion extending to form a joining portion, thereby resulting in formation of an inner layer cloth which is then extended beyond the joining portion to form a second layer cloth.

2 Claims, 12 Drawing Sheets

CLOTH MADE BY CIRCULAR KNITTING MACHINE

BACKGROUND OF THE INVENTION

1. Field of the Invention

The present invention relates generally to a cloth, and more particularly to a cloth made by a circular knitting machine.

2. Description of Related Art

As shown in FIGS. 1–2, a prior art swimsuit is formed of two pieces of cloth, an upper piece and a lower piece 11 which are joined together by a line of stitches. As shown in FIGS. 3–4, a one-piece underwear 12 of the prior art is provided with two cups, each having a cup padding 13 which is joined with the cup along with a piece of cloth 14 by sewing.

Such tight-fitting garments of the prior art as described above are defective in design in that the flexibility around the seam is apt to weaken, thereby undermining the overall fitness of the tight-fitting garments.

BRIEF SUMMARY OF THE INVENTION

The primary objective of the present invention is to provide a cylindrical fabric material which is devoid of the seam and is made by a circular knitting machine.

The features and the advantages of the present invention will be readily understood upon a thoughtful deliberation of the following detailed description of the present invention with reference to the accompanying drawings.

DETAILED DESCRIPTION OF THE INVENTION

Figure 1:
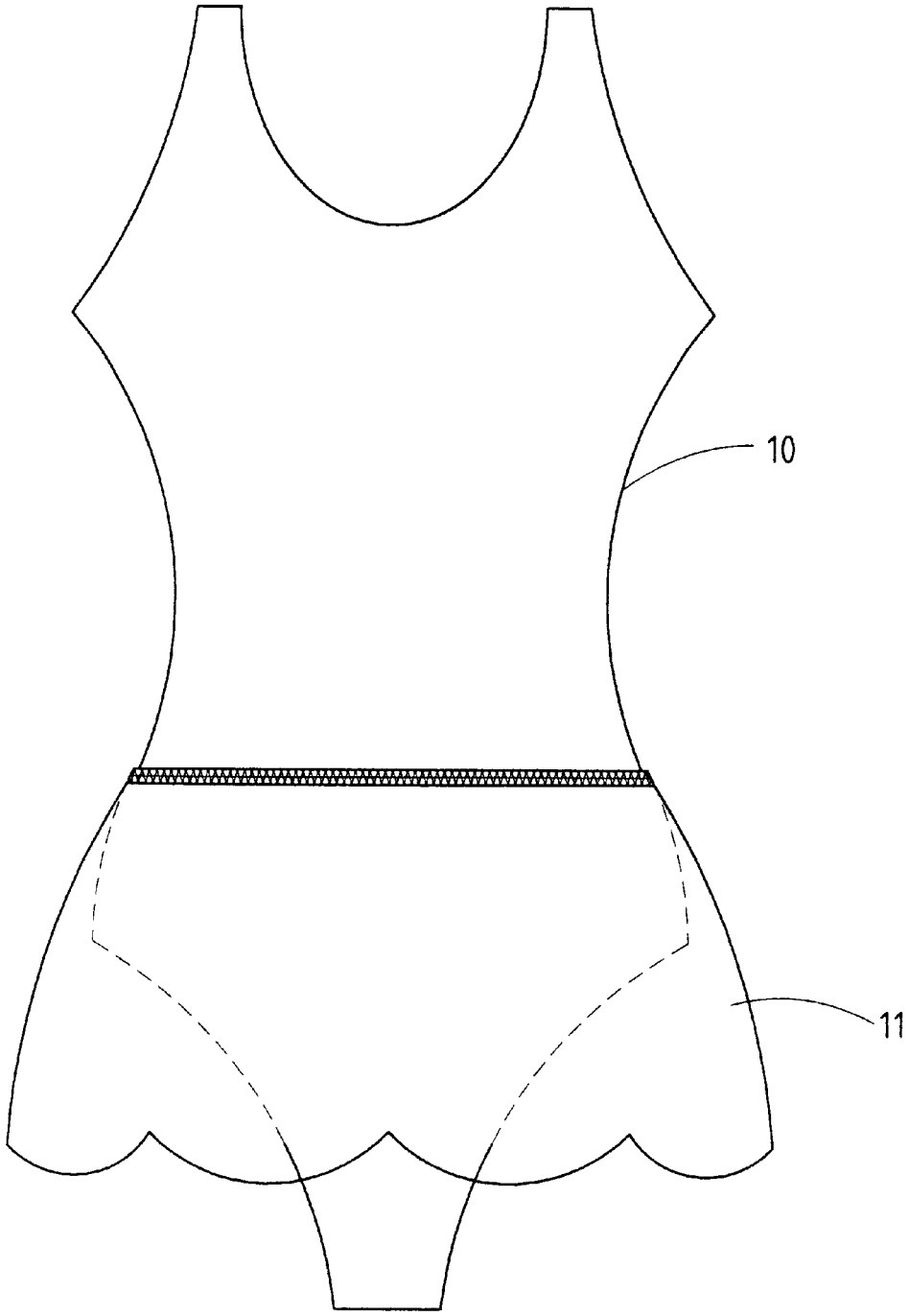
FIG. 1 PRIOR ART
FIG. 1 shows a schematic view of a swimsuit of the prior art.
Figure 2:
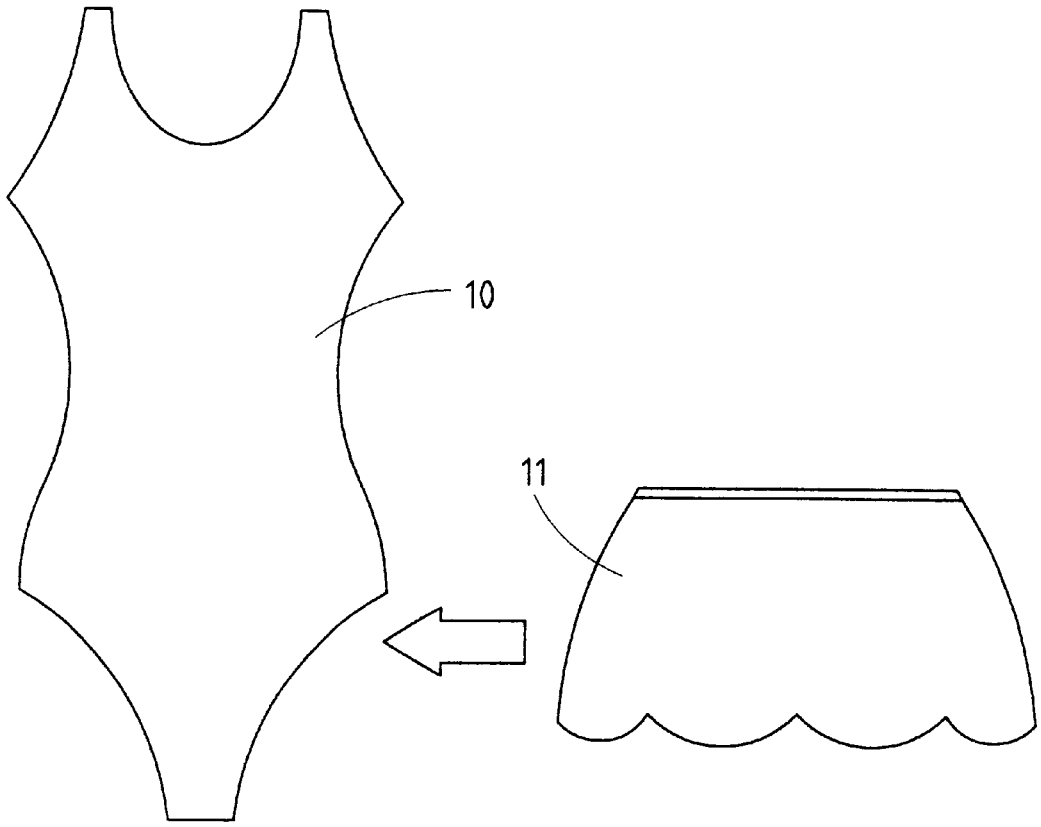
FIG. 2 PRIOR ART
FIG. 2 shows an exploded schematic view of the prior art swimsuit as shown in FIG. 1.
Figure 3:
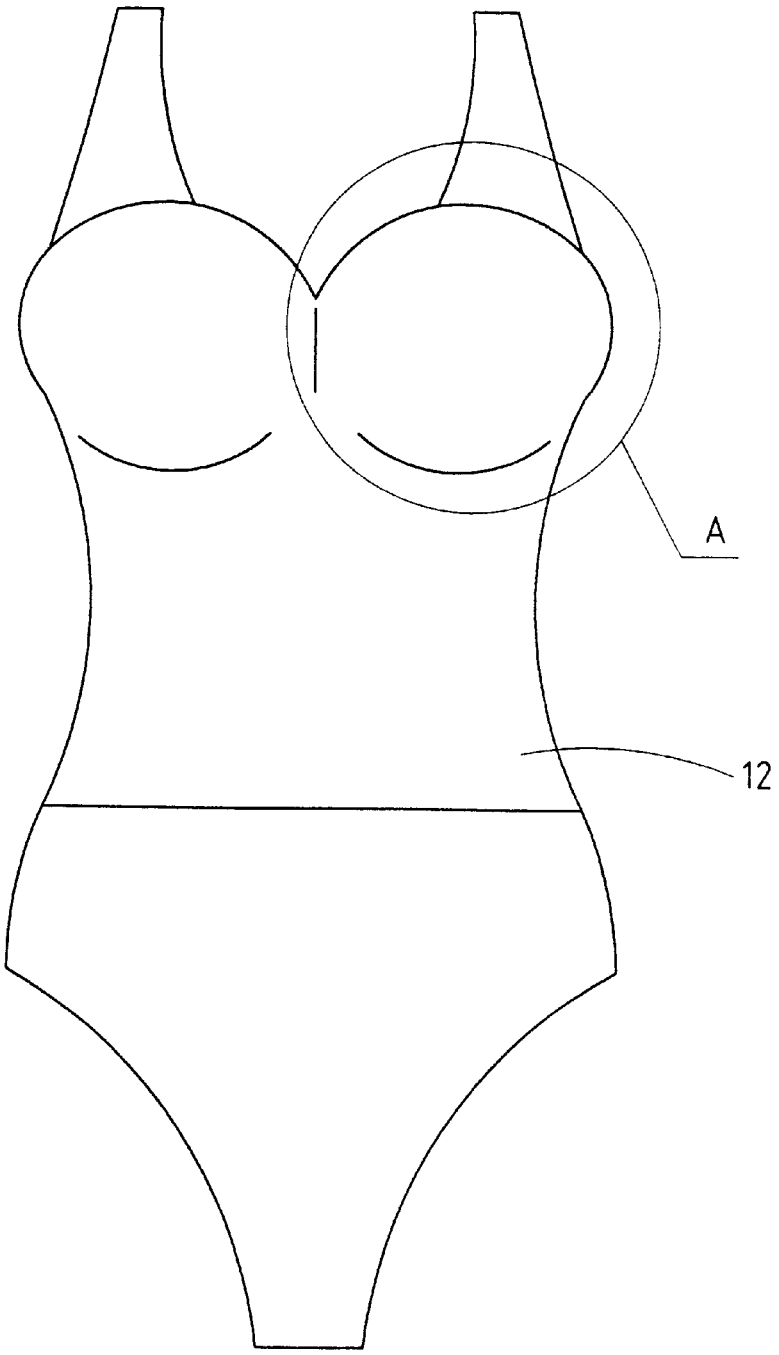
FIG.3 PRIOR ART
FIG. 3 shows a schematic view of a lady's underwear of the prior art.
Figure 4:
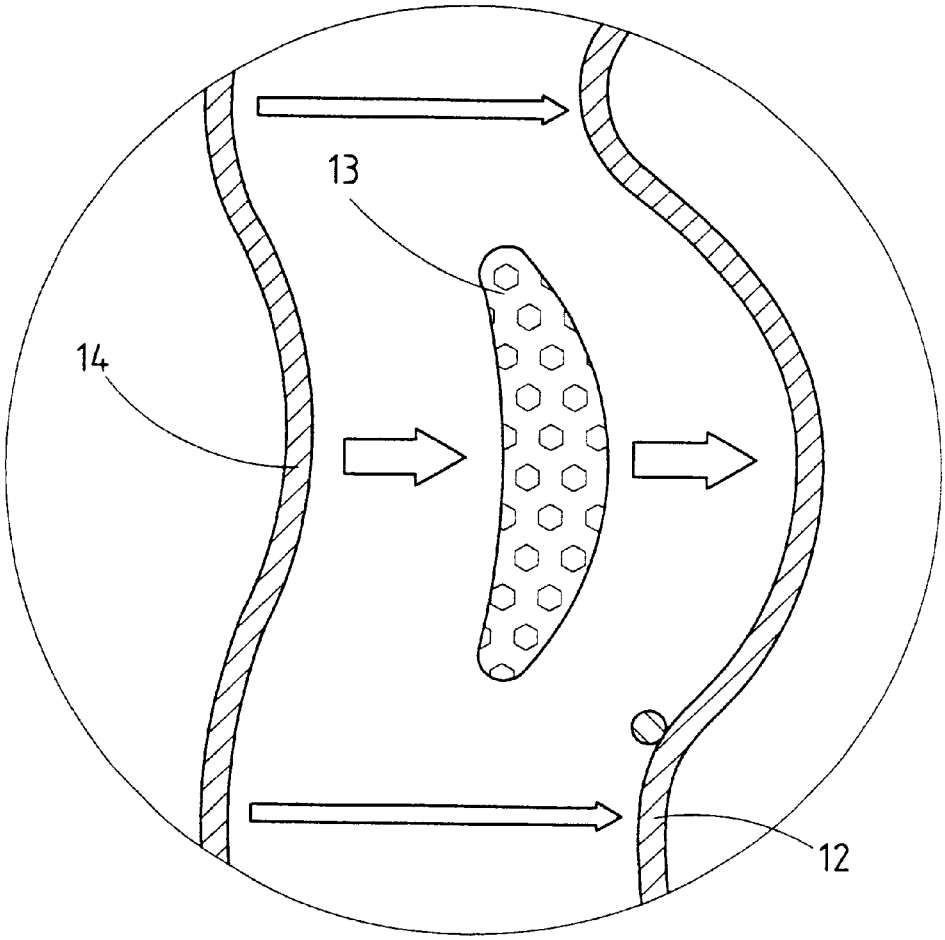
FIG. 4 PRIOR ART
FIG. 4 shows an enlarged sectional view of a portion indicated by a circle "A" as shown in FIG. 3.
Figure 5:
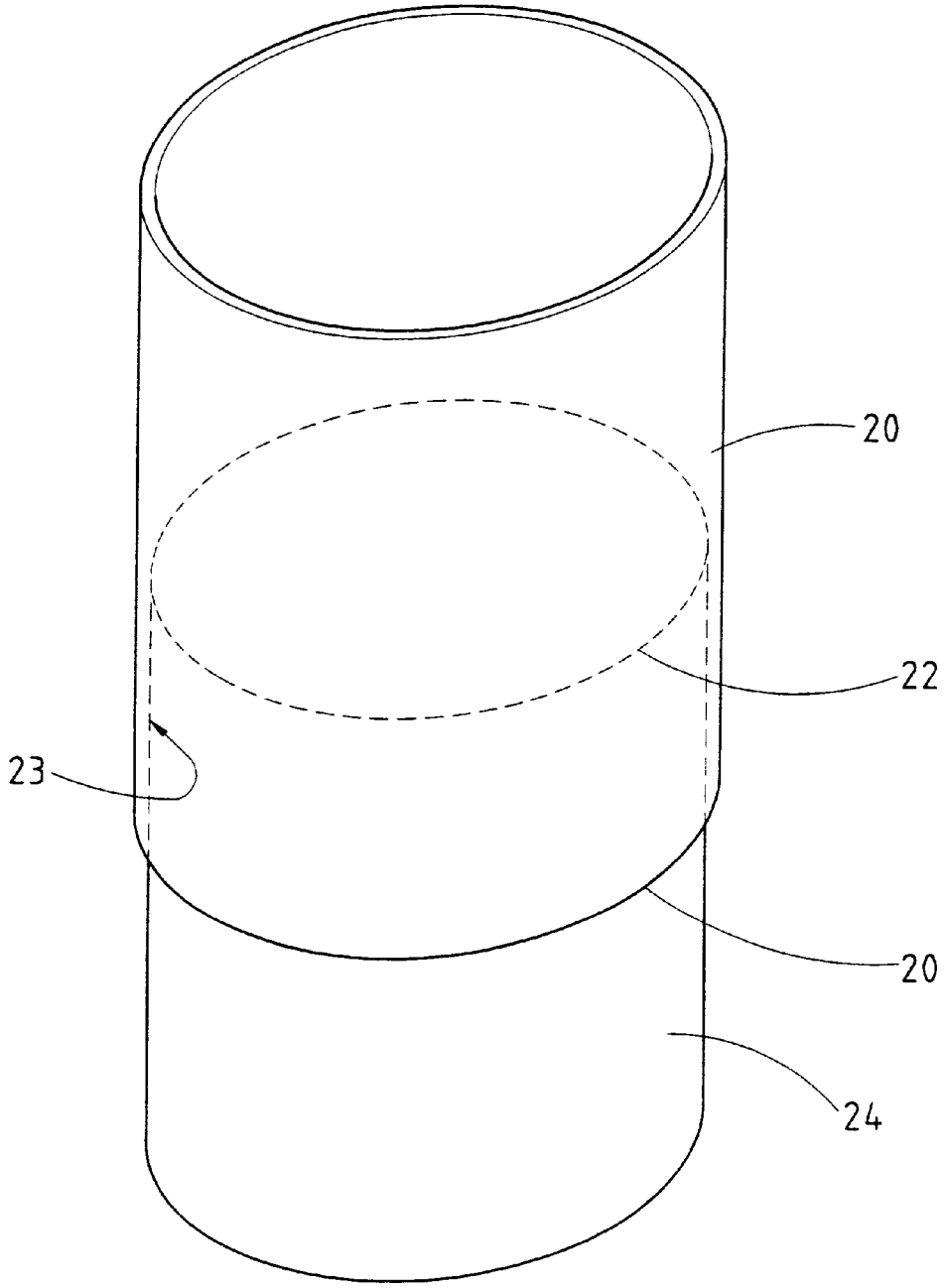
FIG. 5 shows a perspective view of the present invention.

As shown in FIGS. 5–12, a cloth material 20 of the present invention is intended for use in making a variety of seamless garments and is made by a circular knitting machine.

The cloth material 20 is of a cylindrical form and devoid of seam. The seamless cylindrical cloth material 20 is provided in one or two sides with at least one folded portion 21 which is extended to form with the cloth material 20 a joining portion 22, thereby resulting in formation of an inner layer cloth 23. The inner layer cloth 23 is extended beyond the joining portion 22 to form a second layer cloth 24.

Figure 7:
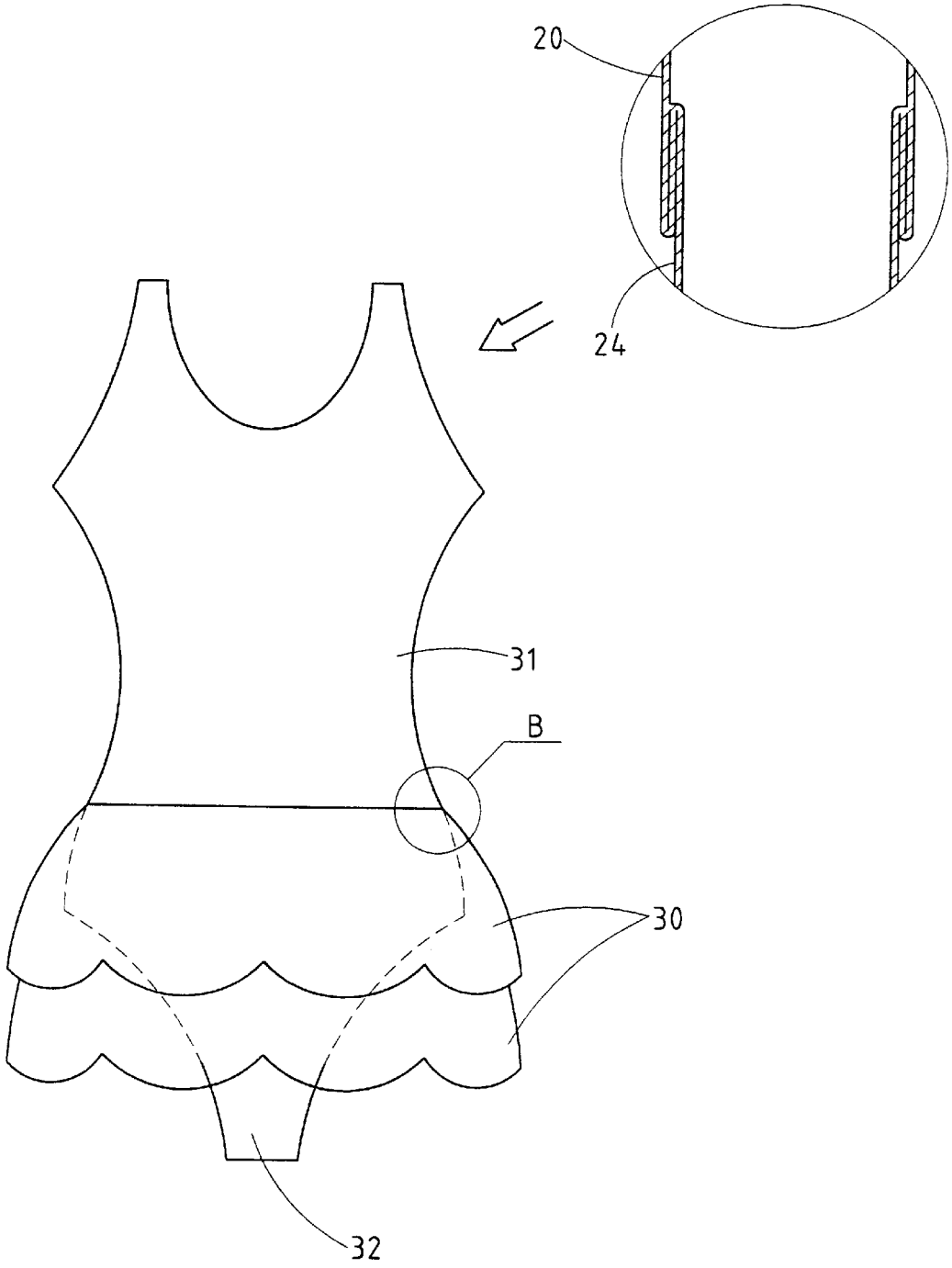
FIG. 7 shows a schematic view of a garment made of the cloth material of the present invention.
Figure 8:
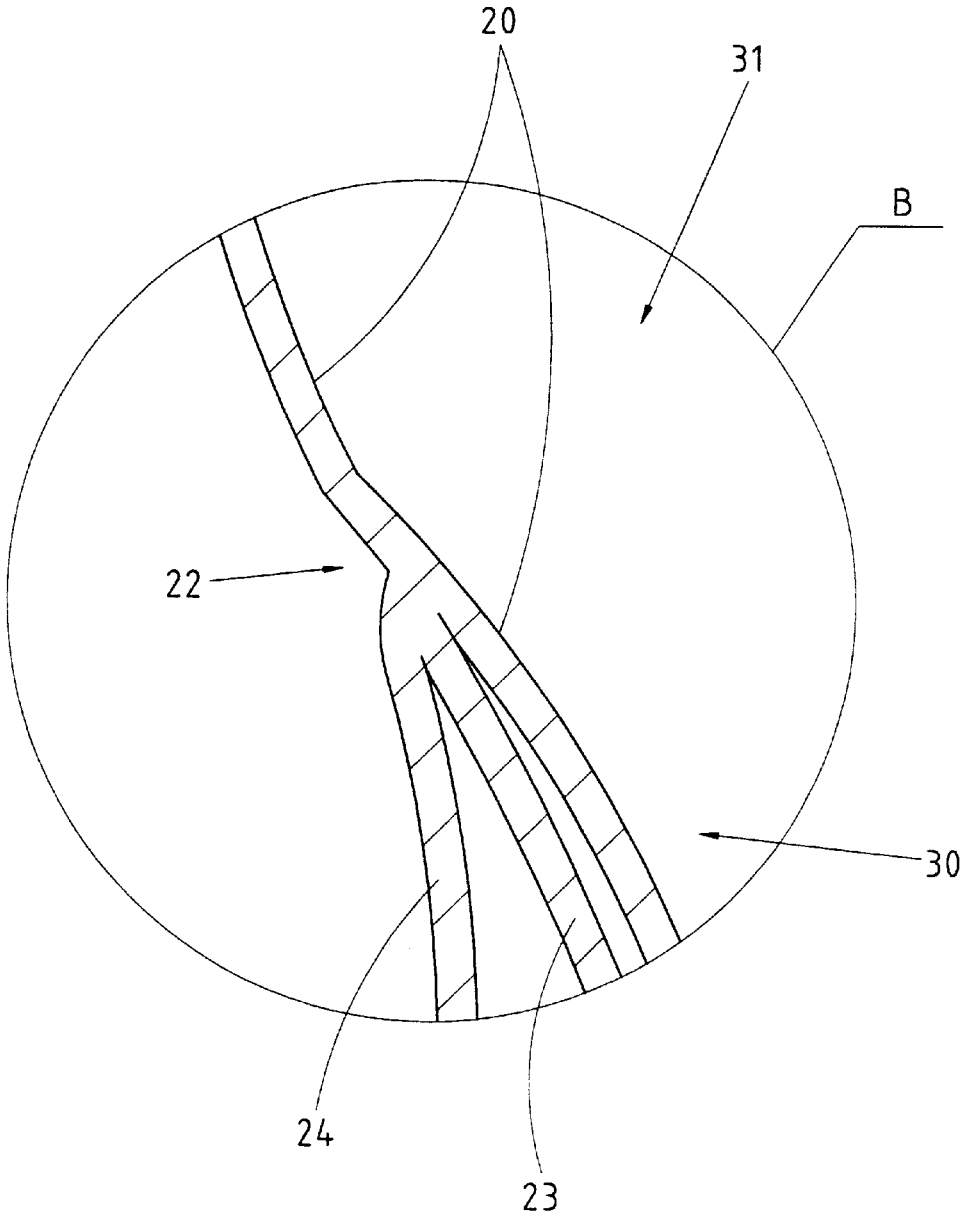
FIG. 8 shows an enlarged sectional view of a portion indicated by a circle "B" as shown in FIG. 7.

As shown in FIG. 7, the cloth material 20 with the second layer cloth 24 extending downwards can be used to make a swimsuit 31 having a skirt portion which is provided with a plurality of pleated layers 30. The pleated layers 30 are formed by the inner layer cloth 23. The second layer cloth 24 is formed into a crotch 32.

Figure 9:
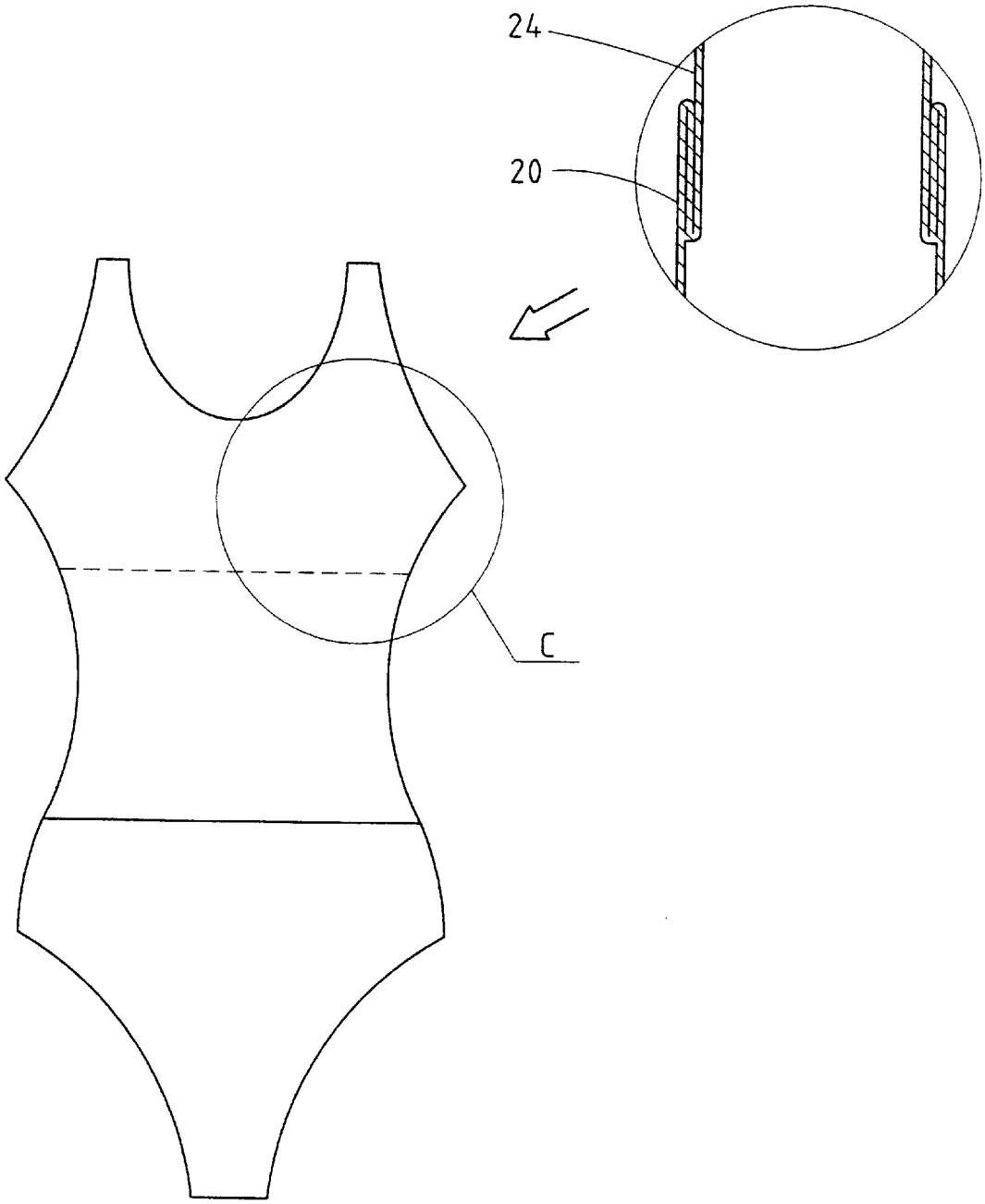
FIG. 9 shows a schematic view of another garment made of the cloth material of the present invention.
Figure 10:
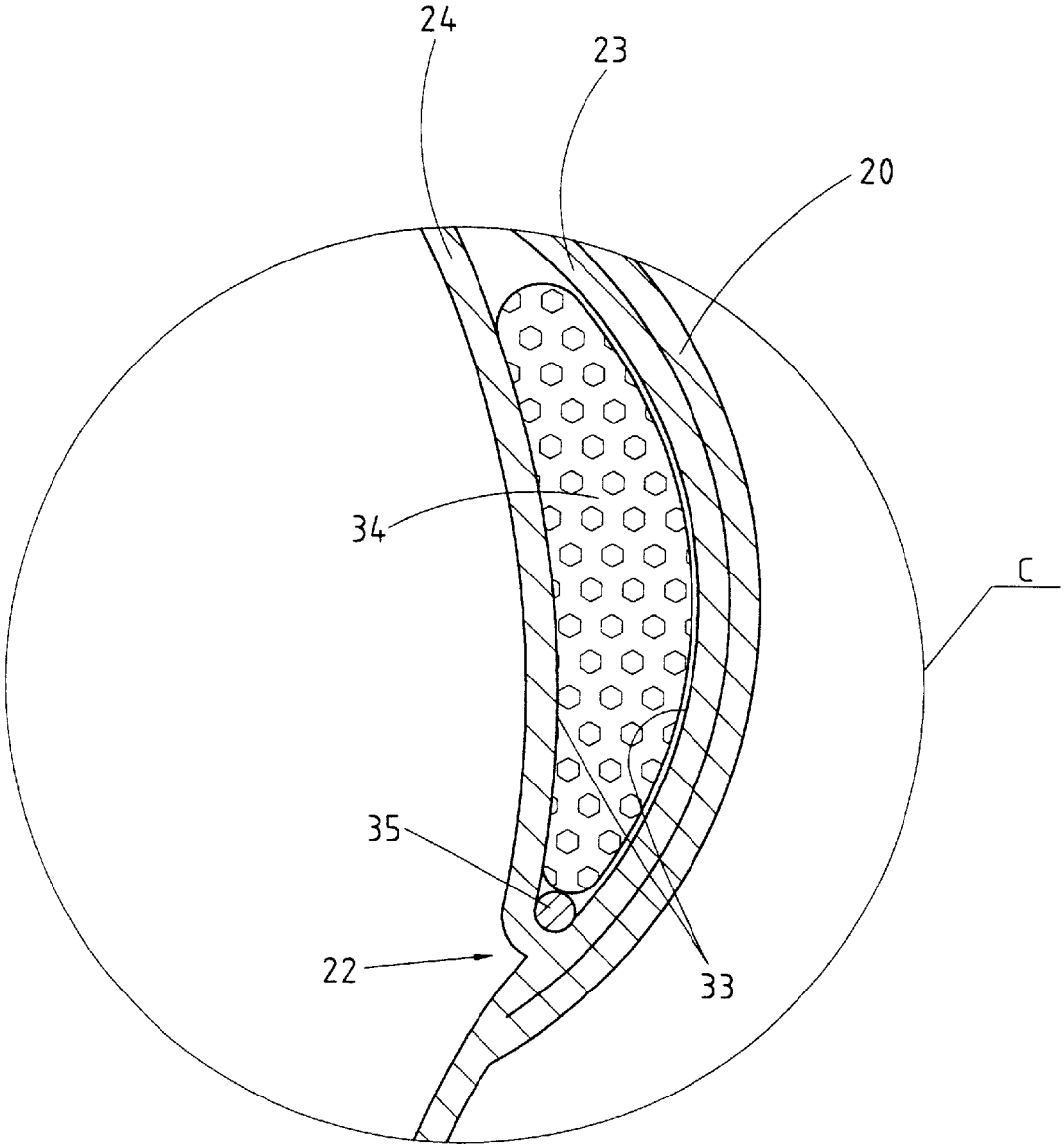
FIG. 10 shows an enlarged sectional view of a portion indicated by a circle "C" as shown in FIG. 9.

As shown in FIGS. 9 and 10, the cloth material 20 with the second layer cloth 24 extending upwards can be used to form a one-piece underwear having two holding layers 33. The holding layers 33 are formed between the inner layer cloth 23 and the second layer cloth 24 for locating a cup padding 34 and a steel support wire 35.

Figure 6:
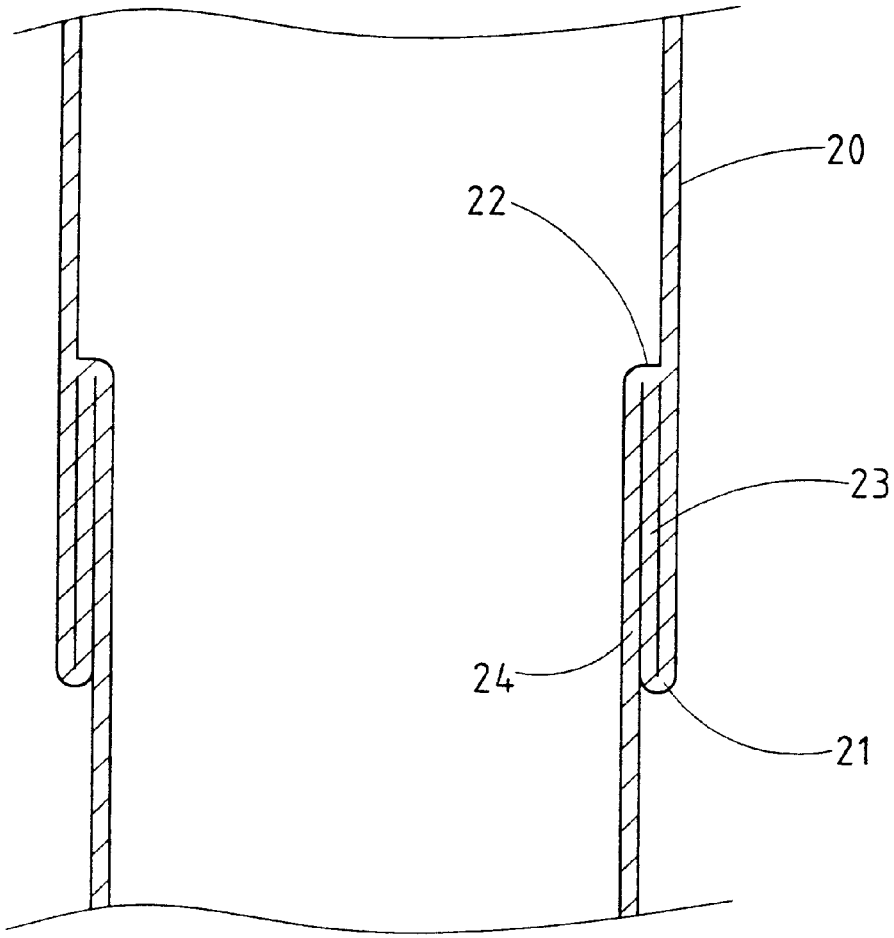
FIG. 6 shows a longitudinal sectional view of the present invention.
Figure 11:
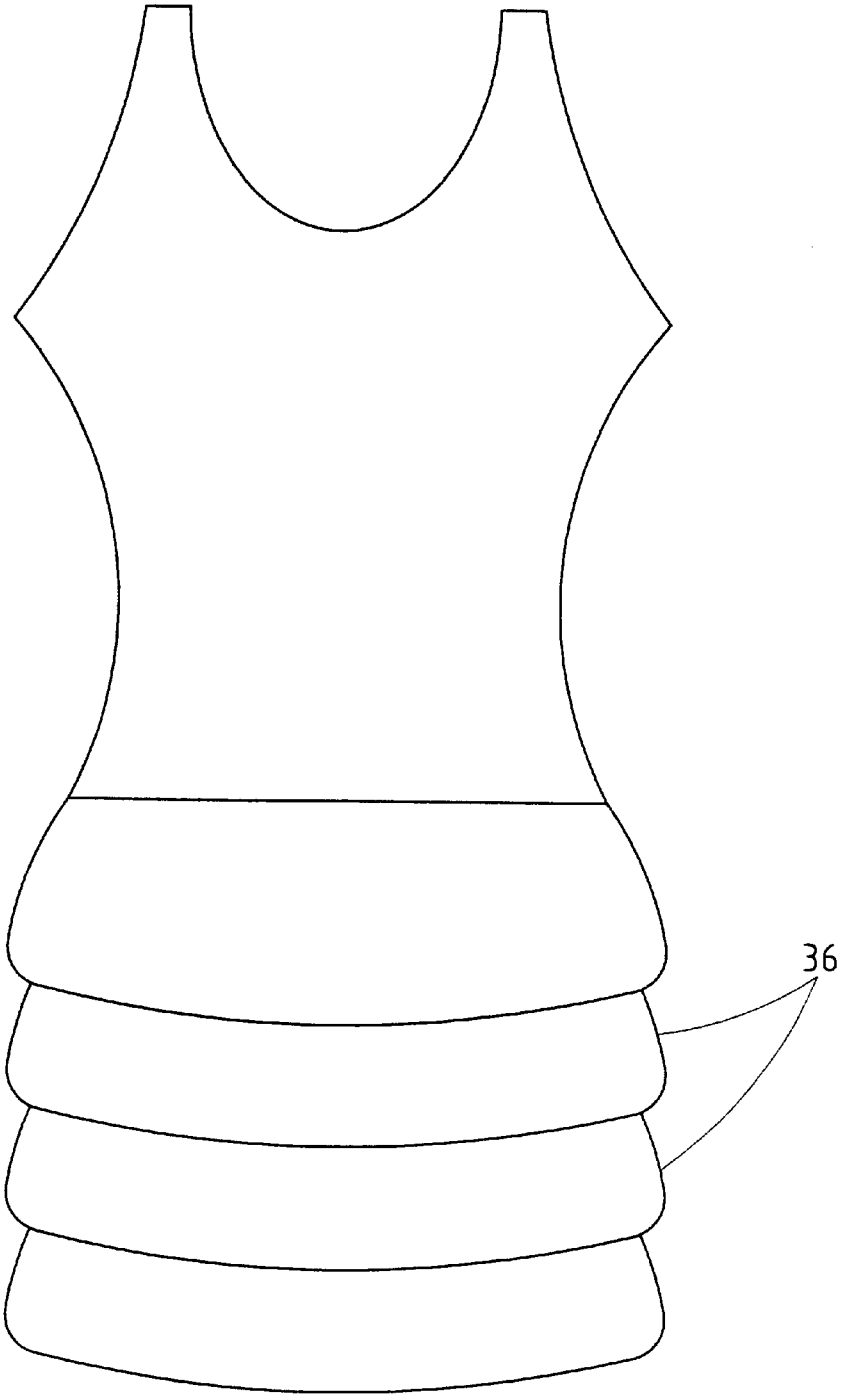
FIG. 11 shows a schematic view of still another garment made of the cloth material of the present invention.
Figure 12:
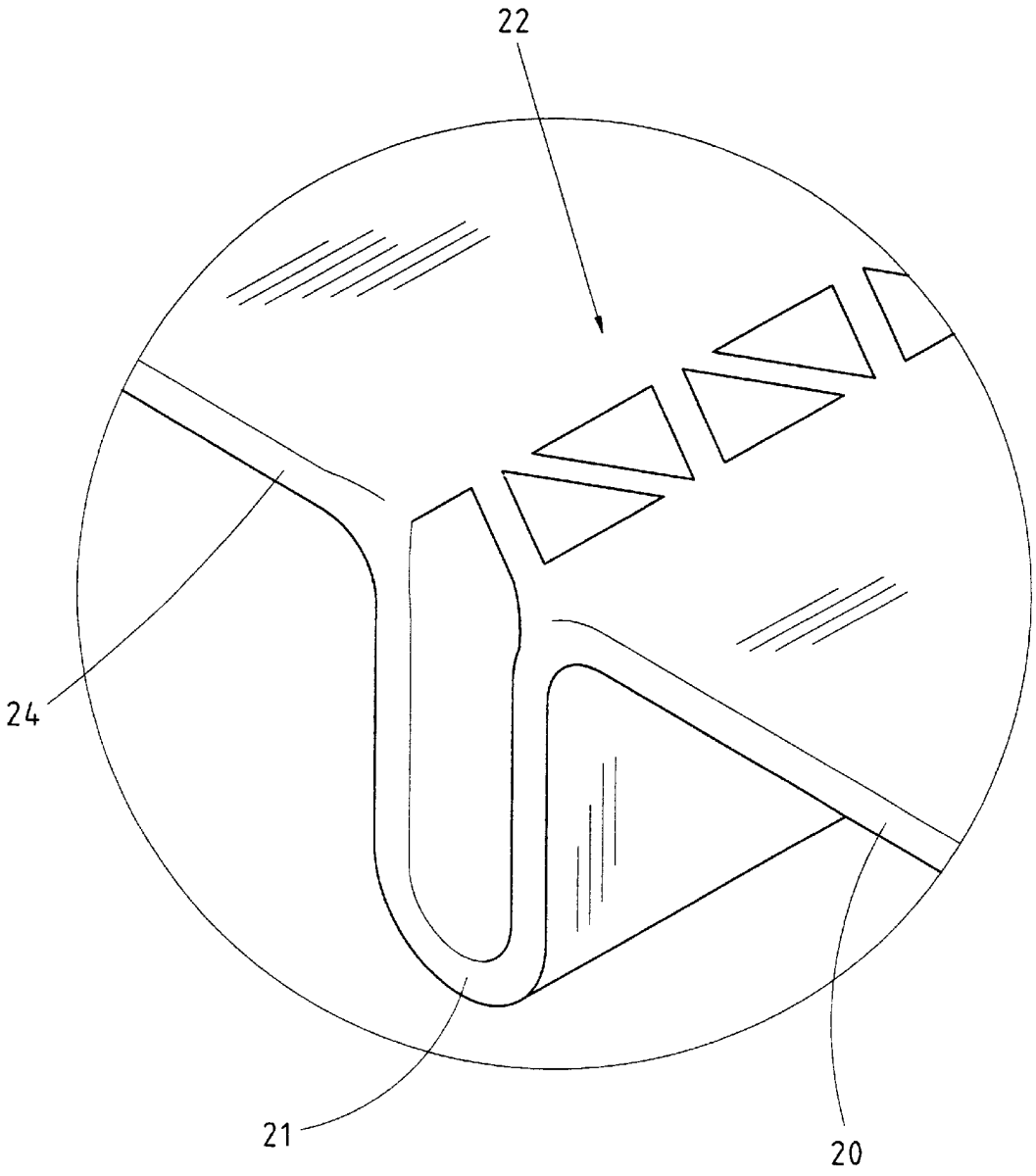
FIG. 12 show a detailed schematic view of the joining portion of the present invention.

As shown in FIGS. 6 and 11, the folded portion 21, the inner layer cloth 23, the joining portion 22, and the second layer cloth 24 are extended repeated to form by knitting a garment which is provided with a plurality of folded edges 36.

The seamless cloth of the present invention always keeps its flexibility in an original state. The seamless cloth of the present invention can be used to make versatile garments.

The present invention described above is to be regarded in all respects as being illustrative and non-restrictive. Accordingly, the present invention may be embodied in other specific forms without deviating from the spirit thereof. The present invention is therefore to be limited only by the scope of the following claim.

I claim:

1. A clothing article comprising:

a tubular cloth section having at least one folded portion extending therearound and interior thereof, the folded portion having a joining section extending around and sewed to an interior of said cloth section, said folded portion defining a holding area therein and extending around an interior of said tubular cloth section, said tubular cloth section having an inner cloth layer extending beyond said folded portion and interior of said holding area, said folded portion and said joining section and said inner cloth layer being integrally formed together; and a padding received within said holding area and secured therein.

2. The clothing article of claim 1, further comprising:

a support wire positioned in said holding area adjacent said joining section and below said padding.

* * * * *